US010640906B2

(12) United States Patent
Tsujino

(10) Patent No.: US 10,640,906 B2
(45) Date of Patent: May 5, 2020

(54) WASHING MACHINE

(71) Applicants: AQUA CO., LTD., Tokyo (JP); QINGDAO HAIER WASHING MACHINE CO., LTD., Qingdao, Shandong (CN)

(72) Inventor: Yoshinori Tsujino, Tokyo (JP)

(73) Assignees: AQUA CO., LTD., Tokyo (JP); QINGDAO HAIER WASHING MACHINE CO., LTD., Qingdao, Shandong (CN)

( * ) Notice: Subject to any disclaimer, the term of this patent is extended or adjusted under 35 U.S.C. 154(b) by 181 days.

(21) Appl. No.: 15/580,548

(22) PCT Filed: Jun. 8, 2016

(86) PCT No.: PCT/CN2016/085230
§ 371 (c)(1),
(2) Date: Dec. 7, 2017

(87) PCT Pub. No.: WO2016/197939
PCT Pub. Date: Dec. 15, 2016

(65) Prior Publication Data

US 2018/0179688 A1 Jun. 28, 2018

(30) Foreign Application Priority Data

Jun. 10, 2015 (JP) ..... 2015-117789

(51) Int. Cl.
*D06F 39/00* (2020.01)
*D06F 34/18* (2020.01)
(Continued)

(52) U.S. Cl.
CPC ..... *D06F 34/18* (2020.02); *D06F 23/04* (2013.01); *D06F 33/00* (2013.01); *D06F 37/40* (2013.01);
(Continued)

(58) Field of Classification Search
CPC ..... D06F 39/003
See application file for complete search history.

(56) References Cited

U.S. PATENT DOCUMENTS

2011/0192655 A1 8/2011 Kim et al.
2011/0202303 A1 8/2011 Petronilho et al.

FOREIGN PATENT DOCUMENTS

CN 1464094 12/2003
CN 1464094 A 12/2003
(Continued)

OTHER PUBLICATIONS

International Application No. PCT/CN2016/085230, International Search Report, dated Sep. 14, 2016.
(Continued)

*Primary Examiner* — Jason Y Ko
(74) *Attorney, Agent, or Firm* — Greenberg Traurig

(57) ABSTRACT

A washing machine includes: a dewatering drum provided with an impeller in a free rotation manner; a driving part for rotating the impeller; an inertial rotation number detection part for detecting an inertial rotation number after the driving part stops driving; and a control part for controlling the driving part and the inertial rotation number detection part and detecting the amount of the washings in the dewatering drum as a load according to the inertial rotation number. In the case of determining that a detection result of the inertial rotation number detection part satisfies a specified condition, the control part enables the driving part to drive again; and the inertial rotation number detection part re-detects the inertial rotation number of the impeller, and detects the load according to the detection result and the previous detection result.

4 Claims, 5 Drawing Sheets

(51) Int. Cl.

| | |
|---|---|
| *D06F 23/04* | (2006.01) |
| *D06F 33/00* | (2020.01) |
| *D06F 37/40* | (2006.01) |

(52) U.S. Cl.
CPC ..... *D06F 2202/10* (2013.01); *D06F 2204/06* (2013.01); *D06F 2204/086* (2013.01)

(56) References Cited

FOREIGN PATENT DOCUMENTS

| | | | |
|---|---|---|---|
| CN | 1464099 | | 12/2003 |
| EP | 2 354 296 | A1 | 8/2011 |
| JP | 2003000986 | | 1/2003 |
| JP | 2003205194 | | 7/2003 |

OTHER PUBLICATIONS

Extended European Search Report for Application No. 16806837.7, dated Mar. 7, 2019.

WASHING MACHINE

The present application is a national phase application under 35 U.S.C. § 371 of International Patent Application PCT/CN2016/085230 filed on Jun. 8, 2016, which claims priority to Japanese patent application No. 2015-117789, filed on Jun. 10, 2015, the entire disclosures of which applications are hereby incorporated herein by reference.

TECHNICAL FIELD

The present disclosure relates to a washing machine which can automatically and correctly detect a load associated with an amount of washings even if a small amount of wet washings is put into the washing machine.

BACKGROUND

In the past, a known washing machine determines an amount of washings in a washing drum as a load at the beginning of a washing process, and controls the washing operation according to a result of the determination (e.g., patent literature 1). In the washing machine disclosed by the patent literature 1, when a start button is pressed, an impeller arranged inside a washing drum rotates for a specified time, a number of pulses is measured and is compared with reference data for load determination to determine if the load is extremely small, small, low, medium or high, such that the washing operation is controlled. Thus, for the washing machine of the patent literature 1, the larger the amount of the washings in the washing drum are, the more difficult the impeller is to rotate; and the load is determined according to the change of the number of pulses.

EXISTING TECHNICAL LITERATURE

Patent Literature

Patent literature 1: Japanese Laid-Open Patent Publication No. 2003-205194

Problems to be Solved by the Disclosure

However, sometimes, for example, the washings (clothes) may be washed by hands (pre-washed) before being washed by the washing machine, and in this case, it is more likely that the washings in a wet state are piled into a ball and put into the washing drum. Therefore, in the case that the amount of the washings containing a great amount of water after being pre-washed (the water amount per unit weight of the washings is large) is small, it is more likely that, the washings A are disposed at the proximity 5*b* of a center of an impeller 5 as shown in FIG. 5(*a*) or the washings A are disposed on a peripheral part 5*a* of the impeller 5 as shown in FIG. 5(*b*).

Furthermore, in the case that a small amount of wet washings A is disposed at the proximity 5*b* of the center of the impeller 5, and particularly when the washings A are blocky, even if the impeller 5 rotates, the impeller 5 suffers a small resistance (friction) from the washings A, and the impeller 5 is easy to rotate.

On the other hand, when the impeller 5 rotates in the case that a small amount of wet washings A is disposed on the peripheral part 5*a* of the impeller 5, since the washings A contact a wall surface 4*a* of the washing drum 4 and rub against an upright blade part 5*c* of the impeller 5, compared with the case described above, the resistance (friction) from the impeller 5 is increased, and the impeller 5 is difficult to rotate.

In this way, even if the amount of the washings A is the same, the ease of rotation of the impeller 5 is quite different according to the amount and water content of the washings A and a location of the washings A in the washing drum 4.

Since the washing machine disclosed in the patent literature 1 only performs one-time processing for rotating the impeller for the specified time during load determination, in the case, for example, described above that a small amount of wet washings A is disposed on the peripheral part 5*a* of the impeller 5, the impeller 5 becomes difficult to rotate, so that the load may be determined to be greater than the actual amount of the washings A, and the correct determination of the load can be further improved. It shall be noted that, for example, in the case that the load is used for determining the water amount stored in the washing drum during washing, when the load is determined to be greater than the actual load, the washings A may be washed with water of more than the necessary amount, leading to a waste of water.

SUMMARY

The present disclosure aims at effectively solving this problem. An objective of some embodiments of the present disclosure is to provide a washing machine which can correctly and automatically detect an actual amount of washings in a washing drum every time as a load regardless of an amount and a water content of the washings.

Solution to the Problem

In order to achieve the objective, the present disclosure adopts a solution as described below.

That is, a washing machine of the present disclosure includes: a washing drum capable of accommodating washings and provided with an impeller in a free rotation manner; a driving part for rotating the impeller; an inertial rotation number detection part for detecting a number of turns of inertial rotation of the impeller after the driving part stop driving, the number of turns is an inertial rotation number; and a control part for controlling the driving part and the inertial rotation number detection part, and detecting the amount of washings in the washing drum as the load according to the inertial rotation number; when the control part determines that a detection result of the inertial rotation number detection part satisfies a specified condition, the control part rotates the driving part again, the inertial rotation number detection part re-detects the inertial rotation number of the impeller at this moment and detects the load according to the detection result and the previous detection result.

Specifically, the present disclosure preferably adopts a structure as follows: when the control part determines that the detection result of the inertial rotation number detection part satisfies the specified condition, the control part compares an absolute value of a difference between two inertial rotation numbers with a specified value, and a load which is detected in the case that the absolute value of the difference is greater than the specified value is smaller than a load which is detected in the case that the absolute value of the difference is smaller than the specified value.

Further, the present disclosure preferably adopts a structure as follows: when the control part determines that the inertial rotation number detected by the inertial rotation number detection part is within a specified range, the control part determines that the specified condition is satisfied and re-detects the inertial rotation number; and in the case that the control part determines that the load is large when the inertial rotation number is smaller than the specified range, and in the case that the control part determines that the load is small when the inertial rotation number goes beyond the specified range, the control part does not re-direct the inertial rotation number.

Furthermore, the present disclosure preferably adopts a structure as follows: the washing machine includes a water supply part for supplying water into the washing drum, and the control part determines the water amount supplied by the water supply part into the washing drum according to the detected load.

Effects of the Disclosure

In the present disclosure described above, when the control part determines that the detection result of the inertial rotation number detection part satisfies the specified condition, the control part re-detects the inertial rotation number, and detects the load according to the detection result and the previous detection result, therefore the following structure can be adopted: even in the case that a small amount of wet washings is initially disposed on the peripheral part of the impeller, for the initial rotating action of the impeller, the resistance to the impeller from the washings is increased, the inertial rotation number is reduced compared with the actual amount of the washings, and the inertial rotation number can also be re-detected to obtain the inertial rotation number when the small amount of wet washings moves from the peripheral part of the impeller. Furthermore, the following structure can be adopted: in the case that the small amount of wet washings is initially disposed near the center of the impeller, for the initial rotating action of the impeller, the resistance to the impeller from the washings is decreased, the inertial rotation number is increased compared with the actual amount of the washings, and the inertial rotation number can also be re-detected to obtain the inertial rotation number when the small amount of wet washings moves from a position near the center of the impeller. Therefore, not only the value of the inertial rotation number, but also the change of the inertial rotation number can be used to detect the load, and the actual amount of the washings can be correctly and automatically detected (automatically set) as the load at every time, regardless of the amount, water content and location of the washings in the washing drum.

Specifically, in the present disclosure, by comparing the absolute value of the difference between the two inertial rotation numbers with the specified value, even in the case that a small amount of wet washings is put into the washing drum, the load can be correctly and easily detected.

Further, in the present disclosure, it is determined that the load is large in the case that the inertial rotation number is smaller than the specified range and that the load is small in the case that the inertial rotation number goes beyond the specified range, and the inertial rotation number is not re-detected in these two cases; and under the condition that the inertial rotation number is difficult to change even if the location of the washings in the washing drum changes, the detection of the inertial rotation number can be completed only once, and unnecessary detection actions can be avoided.

Furthermore, in the present disclosure, the water amount supplied by the water supply part into the washing drum is determined according to the detected load, an appropriate water amount corresponding to the actual amount of the washings can be set automatically, and the water can be saved easily.

LIST OF REFERENCE NUMERALS

1: washing machine; 4: washing drum (dewatering drum); 5: impeller; 6: driving part; 24: water supply valve (water supply part); 26: inertial rotation number detection part; 70: control part; A: washings; T1, T2: inertial rotation number; $|\Delta T|$: absolute value of a difference between the inertial rotation numbers; Th3: specified value (third specified value).

DETAILED DESCRIPTION

Embodiments of the present disclosure are described below with reference to drawings.

Figure 1:
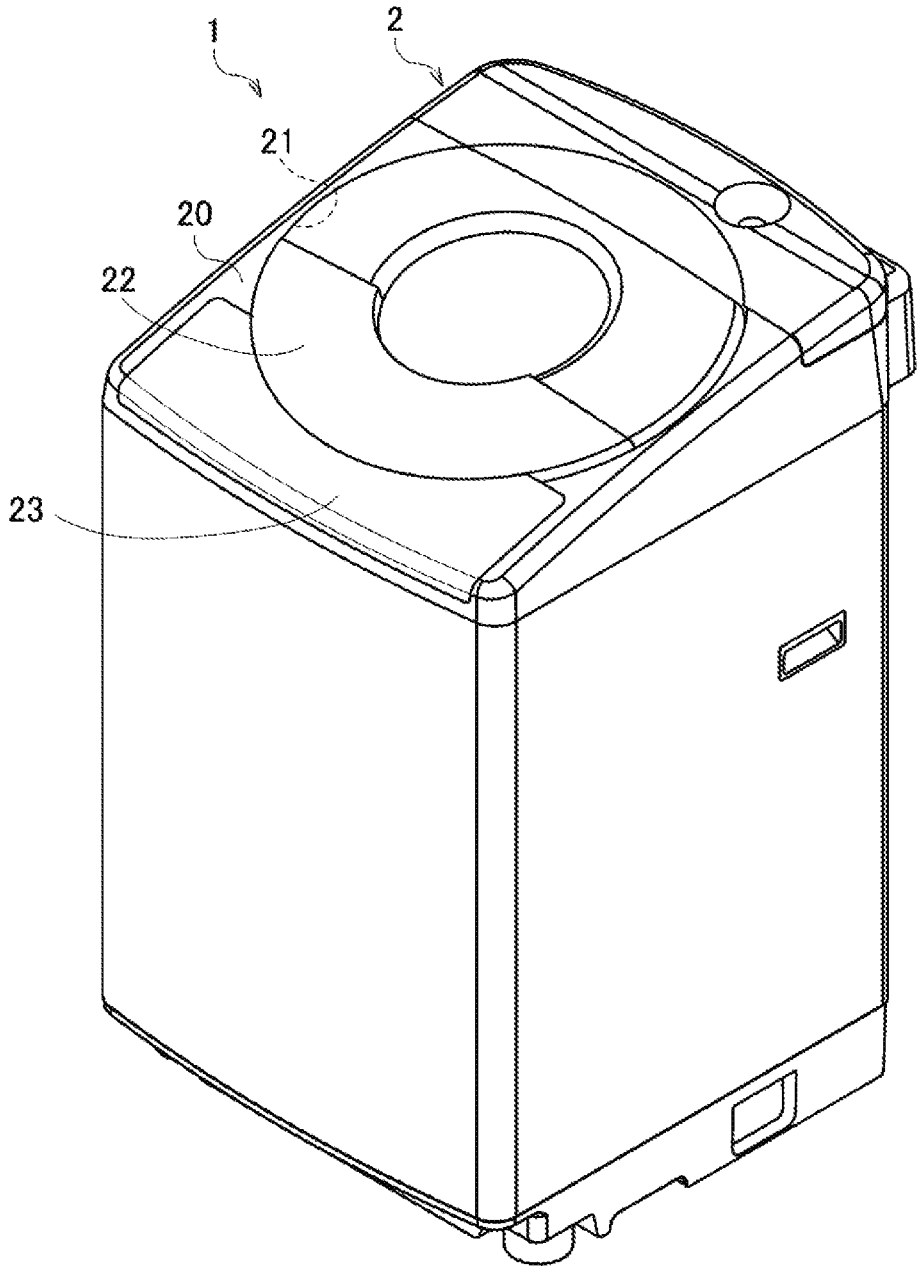
FIG. 1 is a three-dimensional diagram illustrating an appearance of a washing machine of one embodiment of the present disclosure.

FIG. 1 is a three-dimensional diagram illustrating an appearance of a stereoscope washing machine 1 (hereinafter referred as "washing machine") of one embodiment of the present disclosure. Furthermore, FIG. 2 is a longitudinal section view illustrating a general structure of the washing machine 1 of the present embodiment.

Figure 2:
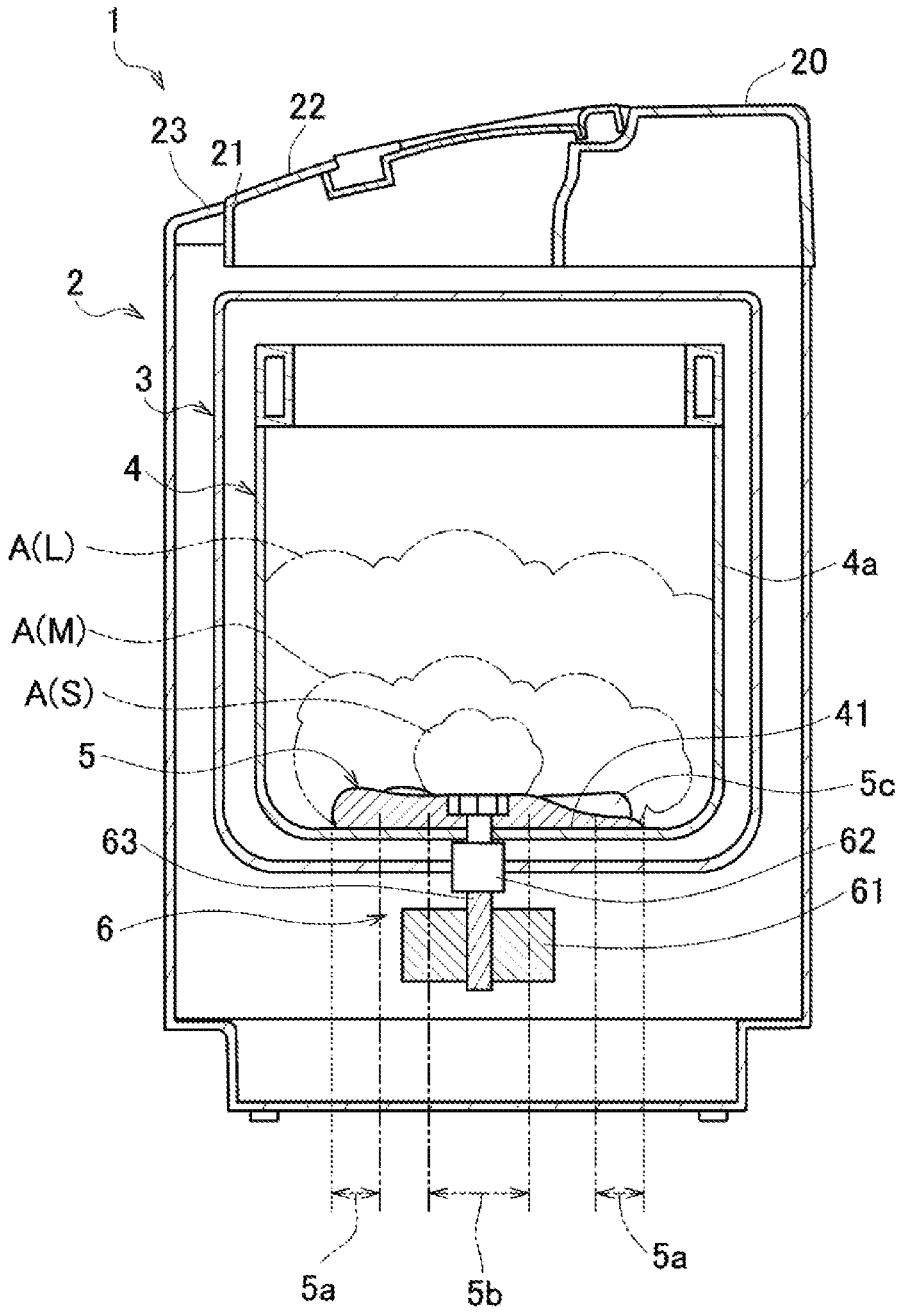
FIG. 2 is a longitudinal section view illustrating a general structure of the same washing machine.
Figure 3:
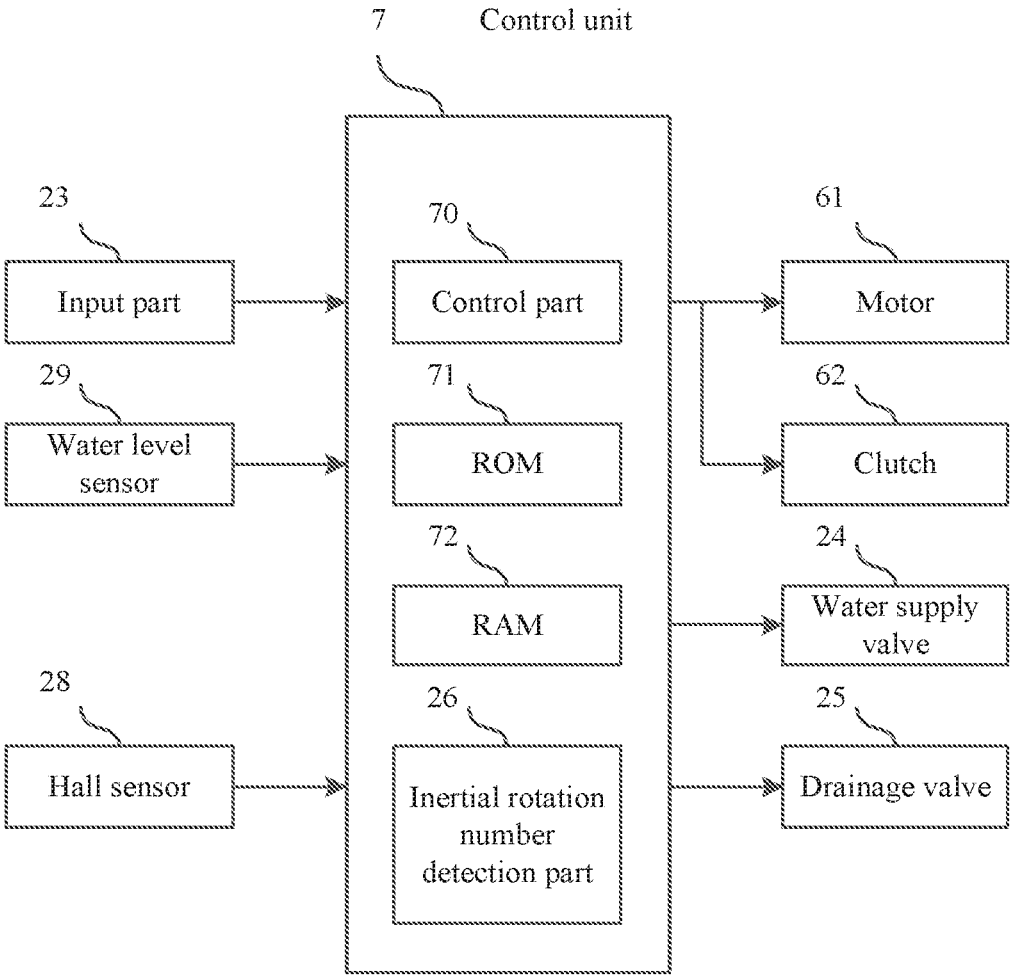
FIG. 3 is a block diagram illustrating an electric structure of the same washing machine.

As shown in FIG. 2, the washing machine 1 of the present embodiment includes: a washing machine body 2, an outer drum 3, a dewatering drum 4, a driving part 6 and a control unit 7 (referring to FIG. 3). In the washing machine 1, when a start button (not shown) formed at an input part 23 and used for starting full-automatic washing is pressed, an amount of washings A located in the dewatering drum 4 is automatically determined as a load, amounts of water stored in the outer drum 3 in a washing process and a rinsing process are automatically determined according to the load, thereby performing washing. A specific structure for automatically determining the load is described later.

The washing machine body 2 adopts a structure as follows: the washing machine body 2 has a substantially cuboid shape; of which an upper surface 20 has an opening 21 for taking in/out the washings (clothes) to/from the dewatering drum 4, and an opening and closing cover 22 for opening and closing the opening 21; and the washings A can be taken in and out of the dewatering drum 4 via the opening 21 by opening the opening and closing cover 22. Furthermore, the input part 23 described above is formed on the upper surface 20 of such a washing machine body 2.

The outer drum 3 shown in FIG. 2 is arranged inside the washing machine body 2 and is a bottomed cylindrical part capable of storing water.

The dewatering drum 4 serving as a washing drum is a bottomed cylindrical component arranged inside the outer drum 3 coaxially with the outer drum 3 and supported through the outer drum 3 in a free rotation manner. The dewatering drum 4 may accommodate the washings A via the opening 21. A diameter of the dewatering drum 4 is smaller than that of the outer drum 3. A wall surface 4*a* of the dewatering drum 4 is provided with a plurality of through holes for water (not shown).

The center of a bottom 41 of the dewatering drum 4 is provided with an impeller (stirring blade) 5 in a free rotation manner. The impeller 5 is an apparatus for stirring the water stored in the outer drum 3 to generate a water flow.

Furthermore, the impeller 5 is an apparatus capable of being driven to rotate at the beginning of the washing process and before the water is supplied to the dewatering drum 4, and a detection value acquired in the rotating process at this moment is used for detecting the above load. In the present embodiment, when the load is detected, the number of turns of inertial rotation of the impeller 5, i.e., an inertial rotation number, is utilized after a driving part 6 stops driving described below. The inertial rotation number is detected through an inertial rotation number detection part described below.

Herein, as shown in FIG. 2, in the case that a large amount of washings A (L) more than a half of a capacity of the dewatering drum 4 is accommodated in the dewatering drum 4, the resistance to the impeller 5 from the washings A is increased, so that the impeller 5 is difficult to rotate inertially, and the inertial rotation number is reduced. Furthermore, as shown in FIG. 2, in the case that a medium amount of washings A (M) which are fewer than a half of the capacity of the dewatering drum 4 and cover the entire impeller 5 is accommodated in the dewatering drum 4, compared with the large amount of the washings A, the impeller 5 becomes easier to rotate, and the inertial rotation number is increased. Further, as shown in FIG. 2, when a small amount of washings A (S) only cover a local part of the impeller 5, as long as other conditions except for the amount of the washings are the same, compared with the case of the medium amount of the washings A, the impeller 5 becomes easier to rotate, and the inertial rotation number is increased.

However, in the case that the washings A are pre-washed by hands (pre-washing), the washings A containing a great amount of water (the water amount per unit weight is large) may be accommodated in the dewatering drum 4 in a blocks. Therefore, in the case that the amount of the washings A is small at this moment, for example, as shown in FIG. 5(*a*), the washings A are located at the proximity 5*b* of a center of the impeller 5 in the blocks.

When the impeller 5 is rotated in this state, the resistance (friction) to the impeller (5) from the washings A is small, and the impeller 5 is easy to rotate. However, with the rotation of the impeller 5, the washings A may be scattered to increase the surface area while moving towards a peripheral part 5*a* of the impeller 5. Thus, the washings A are in a state of running between the impeller 5 and the dewatering drum 4; and when the rotating action of the impeller 5 is preformed again in this state, since the washings A rub against an upright blade part 5*c* of the impeller 5 while contacting the wall surface 4*a* of the dewatering drum 4, the resistance to the impeller 5 from the washings A is increased, and the impeller 5 is difficult to rotate inertially. Therefore, the inertial rotation number at this moment is much smaller than the inertial rotation number detected previously.

Figure 5:
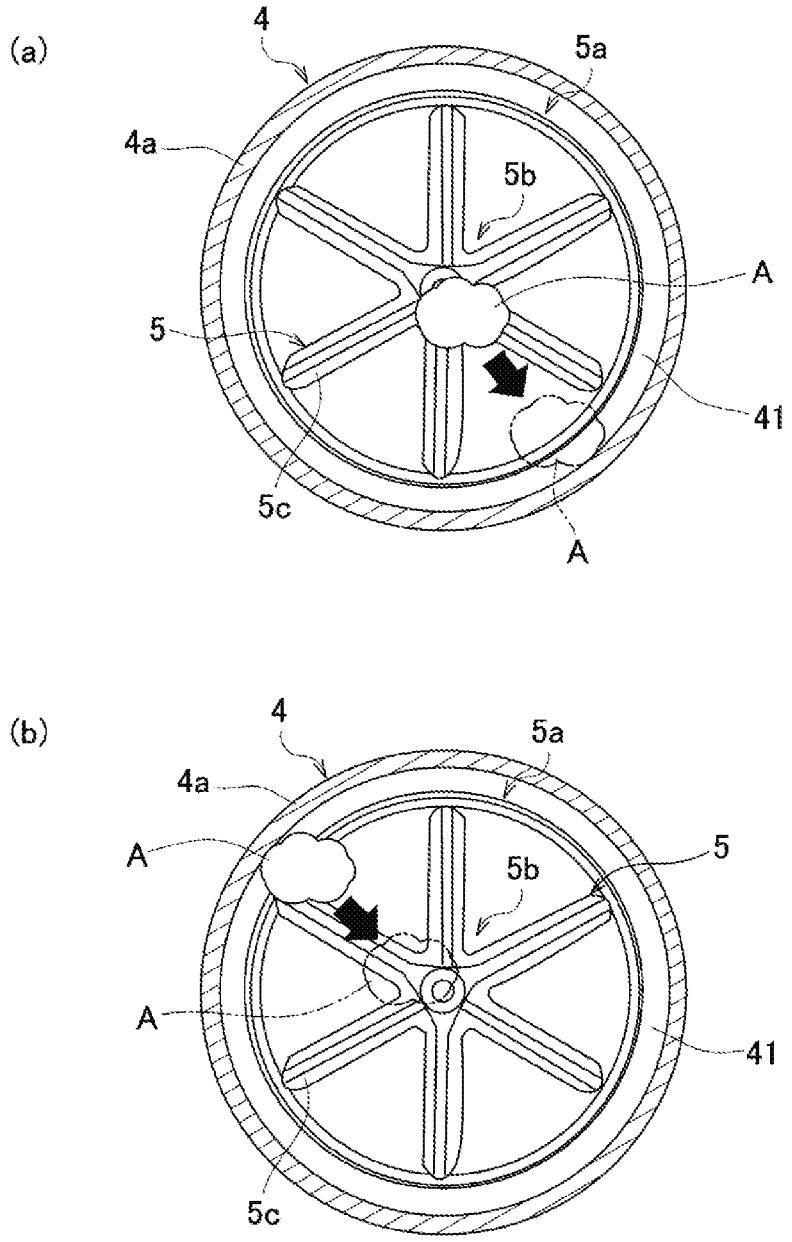
FIG. 5 is a partial top section view illustrating movement of washings in a dewatering drum.

Or, a case that a small amount of wet washings A is present on the peripheral part 5*a* of the impeller 5 as shown in FIG. 5(*b*) may also occur. When the impeller 5 is rotated in this state, the washings A rub against the upright blade part 5*c* of the impeller 5, the resistance to the impeller 5 from the washings A is increased, and the impeller 5 is difficult to rotate inertially. However, with the rotation of the impeller 5, the washings A are formed into blocks while the surface area is decreased, and simultaneously move to the proximity 5*b* of the center of the impeller 5. When the impeller 5 is rotated again in this state, the resistance (friction) to the impeller 5 from the washings A is decreased, and the impeller 5 is easy to rotate inertially. Therefore, the inertial rotation number at this moment is much greater than the inertial rotation number detected previously.

In this way, even if the amount of the washings A is the same, the ease of the inertial rotation of the impeller 5 is also changed according to the amount, the water content and the location of the washings A in the washing drum 4, and the inertial rotation number is likely increased. That is, in the case that a small amount of wet washings A is disposed on the peripheral part 5*a* of the impeller, the inertial rotation number may be smaller than the inertial rotation number corresponding to the actual amount of the washings A and is the inertial rotation number of a degree detected when the amount of the washings A is medium. Furthermore, in the case that a small amount of wet washings A is located at the proximity 5*b* of the center of the impeller, the inertial rotation number may be greater than the inertial rotation number corresponding to the actual amount of the washings A. Therefore, in the case that it is assumed that only one-time inertial rotation number is used for detecting the load, the load may be determined to be greater than the actual amount of the washings A, and the load cannot be correctly determined at every time. In the present embodiment, since the amount of water stored in the outer drum 3 in the washing process and the rinsing process is determined according to the load, water more than needed may be used when the detected load is greater than the load of the actual amount of the washings A.

Returning to FIG. 2, the driving part 6 includes a motor 61 and a clutch 62. The motor 61 rotates a driving shaft 63 extending out of the bottom 41 of the dewatering drum 4, so as to rotate the dewatering drum 4. Furthermore, the motor 61 also applies a driving force to the impeller 5 by switching the clutch 62 so as to rotate the impeller 5. Therefore, the washing machine 1 can mainly rotate the impeller 5 in the washing process and the rinsing process when performing the later load judgment, and can rotate the dewatering drum 4 and the impeller 5 integrally at a high speed in the dewatering process. A rotating speed of the impeller 5 during load determination is set at, for example, 500 to 600 rpm.

FIG. 3 is a block diagram illustrating an electric structure of the washing machine 1 of the present embodiment. The action of the washing machine 1 is controlled through the control unit 7 including a microcomputer. The control unit 7 includes a control part 70, an inertial rotation number detection part 26, a ROM 71 and a RAM 72. A program stored in the ROM71 is executed by the microcomputer to perform a preset operation action. The RAM 72 temporarily stores data (such as the inertial rotation number detected by the inertial rotation number detection part 26) used when the above programs re executed.

Besides the above motor 61 and the clutch 62, the control unit 7 is also connected with, as control objects, a water supply valve 24 serving as a water supply part used for supplying water to the outer drum 3 and a drainage valve 25 for discharging the water from the outer drum 3. It shall be noted that the water supply valve 24 and the drainage valve 25 are not shown in FIG. 2.

Furthermore, besides a signal from the input part 23, signals from a hall sensor 28 mounted on the motor 61 and a water level sensor 29 are also input into the control unit 7. The hall sensor 28 detects a magnetic force when the impeller 5 rotates inertially.

The inertial rotation number detection part 26 detects the number of turns of inertial rotation of the impeller 5, i.e., the inertial rotation number, after the motor 61 stops driving according to the detection result of the hall sensor 28.

The control part 70 controls the driving part 6 including the motor 61 and the clutch 62, and the inertial rotation number detection part 26, detects the amount of the washings A in the dewatering drum 4 as the load according to the inertial rotation number detected by the inertial rotation number detection part 26, and performs the load determination.

The load determination is started when the washings A are put into the dewatering drum 4 and the start button (not shown) of the input part 23 is pressed. When the load determination is started, the control part 70 drives the motor 61 to rotate the impeller 5, and re-drives the motor 61 in the case that the detection result of the inertial rotation number detection part 26 is determined to satisfy a specified condition at this moment; and the inertial rotation number detection part 26 re-detects the inertial rotation number of the impeller 5 and detects the load according to the detection result and the previous detection result. In the present embodiment, the specified condition refers to the condition that the inertial rotation number may be increased after the re-detection, which will be specifically described later.

When this structure is adopted, for example, in the case that a small amount of wet washings A is initially disposed on the peripheral part 5*a* of the impeller 5, even for the initial rotating action of the impeller 5, the resistance to the impeller 5 from the washings A is increased. The inertial rotation number is decreased compared with the actual amount of the washings A, and the re-detection of the inertial rotation number can also be performed to obtain the inertial rotation number when the small amount of wet washings A moves towards the proximity 5*b* of the center from the peripheral part 5*a* of the impeller 5. Furthermore, in the case that a small amount of wet washings A is initially located at the proximity 5*b* of the center of the impeller 5, even if the resistance to the impeller 5 from the washings A is decreased for the initial rotating action of the impeller 5, the inertial rotation number is increased compared with the actual amount of the washings A, and the re-detection of the inertial rotation number can also be performed to obtain the inertial rotation number after a small amount of wet washings A moves to the peripheral part 5*a* from the proximity 5*b* of the center of the impeller 5. Therefore, not only the inertial rotation number, but also the change of the inertial rotation number can be used for detecting the load, and the actual amount of the washings A can be correctly and automatically detected as the load at every time regardless of the amount, the water content and the location of the washings A in the dewatering drum 4.

Furthermore, the control part 70 reads reference value data of the water amount stored in the outer drum 3 from the ROM 71, and adjusts the reference value data according to the load, thereby automatically setting the water amount corresponding to the load to perform the washing action. Therefore, the washing action is performed in such a state that the larger the detected load is, the more water is supplied to the outer drum 3.

In this way, the control part 70 determines the water amount supplied into the dewatering drum 4 via the water supply valve 24 according to the detected load, so that a necessarily sufficient and appropriate amount of water can be automatically set according to the actual amount of the washings A, and the water can be easily saved. Furthermore, since the washings A sufficiently contact the impeller 5 in a state of not floating on a water surface in the washing process when the water amount is appropriate relative to the actual amount of the washings A, the high cleaning performance can be achieved. It shall be noted that the water amount may be set as a value input by a user from through input part 23 sometimes.

The water level sensor 29 is an apparatus for detecting the water amount in the outer drum 3 and outputting the detection result to the control unit 7.

The ROM 71 stores data in advance, such as a reference value of the water amount stored in the outer drum 3, as well as a first specified value, a second specified value, a third specified value used for subsequent load determination. The first specified value is a reference value of the inertial rotation number for determining whether the load is large. The second specified value is set to be greater than the first specified value and is a reference value of the inertial rotation number for determining whether the load is small. The third specified value is a reference value of the inertial rotation number for determining whether the load is medium or small.

By comparing the first specified value and the second specified value with the inertial rotation number, whether the load is large or small is determined according to whether the inertial rotation number is less than the first specified value or greater than the second specified value. Since the third specified value is compared with an overall value of a difference between two inertial rotation numbers by focusing on a point that the inertial rotation number is changed according to the amount and location of the washings A as described above, whether the load is medium or small is determined according to whether the overall value of the difference is greater than the third specified value. That is, since the inertial rotation number is increased in the case that a small amount of the washings A are wet, it is highly probably that the overall value of the difference is greater than the third specified value; in other cases, the inertial rotation number is hardly changed, so that it is less probably that the overall value of the difference is greater than the third specified value. Therefore, as long as the overall value of the difference is greater than the third specified value, it is determined that the load is small; and as long as the overall value is not greater than the third specified value, it is determined that the load is medium.

Figure 4:
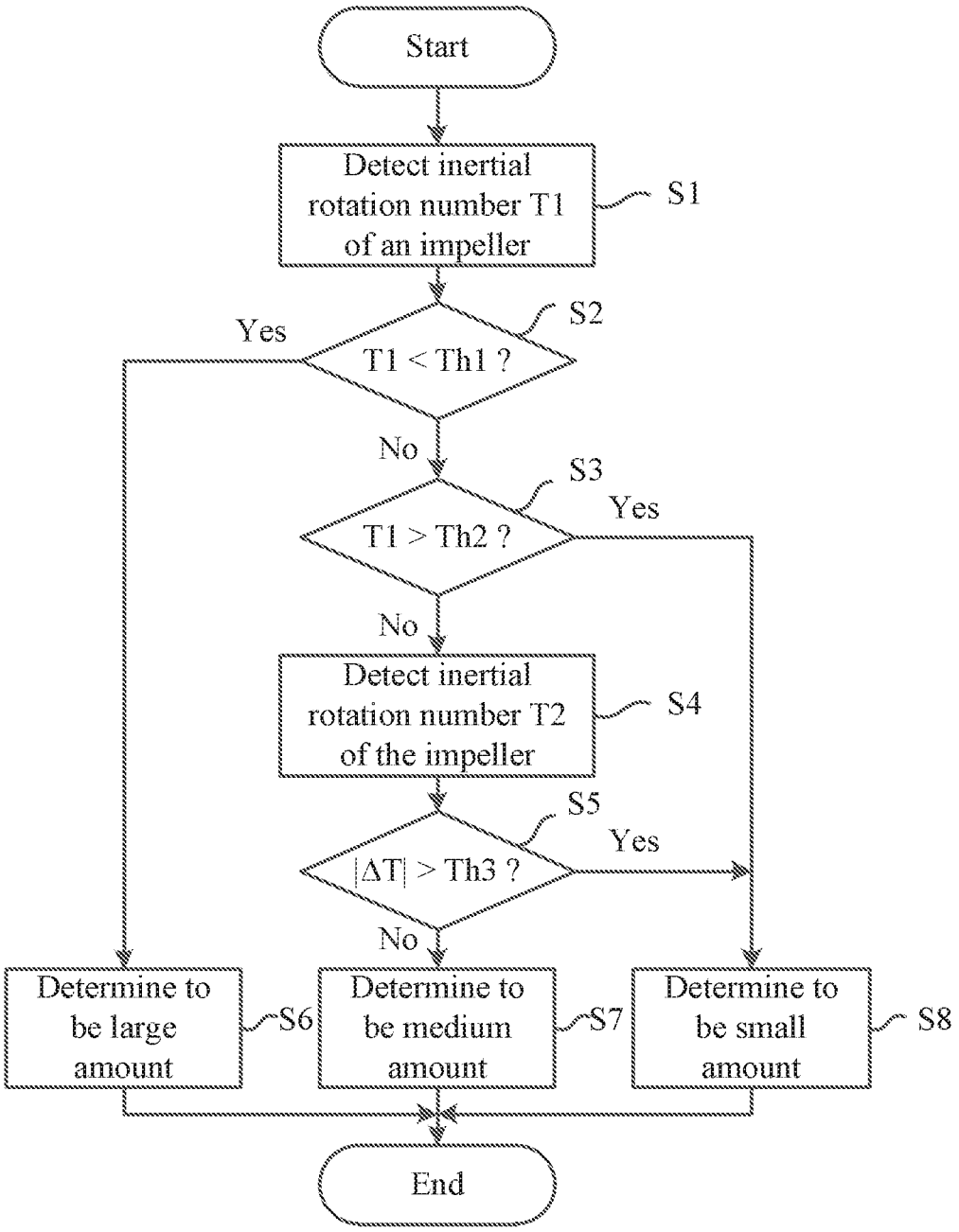
FIG. 4 is a flow chart illustrating a process for determining a load of the same washing machine.

The process for determining the load is specifically described below with reference to FIG. 4. FIG. 4 is a flow chart illustrating a process for determining a load. The present process is started when the start button (not shown) of the input part 23 is pressed and an instruction for performing a full-automatic washing action for automatically setting a water amount is input to the control unit 7.

<Step S1>

In step S1, a control part 70 drives a driving part 6 to rotate an impeller 5 in a state that the water has not been supplied into a dewatering drum 4 through a water supply valve 24; at this moment, an inertial rotating number detection part 26 detects an inertial rotation number T1, which is stored at the RAM 72.

<Step S2>

In step S2, when the control part 70 reads a first specified value Th1 from the ROM 71 and determines that the inertial rotation number T1 is smaller than the first specified value Th1 (step S2: Yes), the control part 70 enters a subsequent step S6. On the other hand, when the control part 70 determines that the inertial rotation number T1 is not smaller than the first specified value Th1 (step S2: No), the control part 70 enters step S3.

<Step S3>

In step S3, when the control part 70 reads a second specified value Th2 from the ROM 71 and determines that the inertial rotation number T1 is greater than the second specified value Th2 (step S3: Yes), the control part 70 enters a subsequent step S8. On the other hand, when the control part 70 determines that the inertial rotation number T1 is not greater than the second specified value Th2 (step S3: No), the control part 70 determines that the above specified condition is satisfied, temporarily determines that the load is medium and enters step S4. That is, the above specified condition specifically refers to a condition that the inertial rotation number T1 is within a specified range from the first specified value Th1 to the second specified value Th2.

<Step S4>

In step S4, the control part 70 drives the driving part 6 again to rotate the impeller 5 under the same condition as that in step S1, and the inertial rotation number detection part 26 re-detects the inertial rotation number T2, which is stored at the RAM 72.

<Step S5>

In step S5, the control part 70 reads the inertial rotation numbers T1, T2 from the RAM 72, and calculates an absolute value ($|T2-T1| \rightarrow |\Delta T|$) of a difference between the inertial rotation number T1 and the inertial rotation number T2. Furthermore, the control part 70 reads the third specified value Th3 from the ROM 71 and enters step S8 when determining that the absolute value $|\Delta T|$ of the difference is greater than the third specified value Th3 (that is, the difference between this detection result and the detection result of last time (first time) is large) (step S5: Yes). On the other hand, when the control part 70 determines that the absolute value $|\Delta T|$ of the difference is not greater than the third specified value Th3 (that is, the difference between this detection result and the detection result of the last time (first time) is small or even 0) (step S5: No), the control part 70 enters step S7.

<Step S6>

In step S6, the control part 70 determines that the load is large, and ends the present process.

<Step S7>

In step S7, the control part 70 determines that the load is medium, and ends the present process.

<Step S8>

In step S8, the control part 70 determines that the load is small (the load is re-determined in the case that it is temporarily determined that the load is medium in step S5), and ends the present process. Therefore, even in the case that a small amount of washings A, which have been pre-washed by hands, are washed by the washing machine 1, it may be correctly determined that the load of the washings A containing a great amount of water is small.

In this way, when the control part 70 determines that the detection result of the inertial rotation number detection part 26 satisfies the specified condition, the control part 70 compares the absolute value $|\Delta T|$ of the difference between the two inertial rotation numbers T1, T2 with the third specified value Th3; and in the case that the absolute value $|\Delta T|$ of the difference is greater than the third specified value Th3, the detected load is smaller than that in the case that the absolute value $|\Delta T|$ of the difference is smaller than the third specified value Th3.

As described above, when a small amount of wet washings A is located on the peripheral part 5*a* of the impeller 5, the inertial rotation number is smaller than that in the case of the actual amount of the washings A; and when the washings A move to the proximity 5*b* of the center of the impeller 5 along with the rotation of the impeller 5, the inertial rotation number is increased greatly compared with that of the last time. On the other hand, when a small amount of wet washings A is located at the proximity 5*b* of the center of the impeller 5, the inertial rotation number is decreased; and when the washings A move to the peripheral part 5*a* of the impeller 5 along with the rotation of the impeller 5, the inertial rotation number is significantly smaller than the previous one. In this way, the inertial rotation number may be increased due to the amount and water content of the washings A, causing that the load cannot be correctly determined.

However, through the above structure, even in the case that a small amount of wet washings is put into the dewatering drum 4, the control part 70 re-detects the inertial rotation number T2 according to the detection result of the first inertial rotation number T1, and utilizes the absolute value $|\Delta T|$ of the difference between the first detection value (measured value) and the second detection value (measured value) to determine the load, thereby correctly, easily and automatically detecting (automatically setting) the load corresponding to the actual amount of the washings A.

Furthermore, the control part 70 adopts a structure as follows: in the case that the inertial rotation number T1 detected by the inertial rotation number detection part 26 is within the specified range, i.e., the range from the first specified value Th1 to the second specified value Th2, it is determined that the specified condition is satisfied and the inertial rotation number is re-detected; on the other hand, it is determined that the load is large in the case that the inertial rotation number T1 is smaller than the specified range; or it is determined that the load is small in the case that the inertial rotation number T1 goes beyond the specified range; and the inertial rotation number T2 is not re-detected in these two cases. That is, in the case that it is determined that the inertial rotation number T1 is smaller than the first specified value Th1 in step S2 or it is determined that the inertial rotation number T1 is greater than the second specified value Th2 in step S3, the processing for determining the load is ended without re-detecting the inertial rotation number.

Even if the location of a rated amount of washings, such as a large amount of washings A (L), and a very small amount of washings A (S) in the dewatering drum 4 is changed, the inertial rotation number is also difficult to change, and the load can be correctly determined by detecting the inertial rotation number T1 for only one time. Therefore, in the cases that a large amount of washings A (L) and a very small amount of washings A(S) are washed, (i.e., even if the location of the washings A in the washing drum is changed, the inertial rotation number is difficult to change), the detection of the inertial rotation number T1 can be completed for one time, and the unnecessary detection action can be avoided.

The washing machine 1 of the present embodiment does not need to be additionally provided with a structure (inertial rotation number detection unit 26, and the like) for detecting the inertial rotation of the impeller 5 which is generally included in an existing washing machine on the purpose of correctly determining the above load, thereby preventing the complication of the apparatus structure.

It shall be noted that the specific structure of each part is not limited to above embodiments.

For example, although it is determined that the specified condition is satisfied in the case that the inertial rotation number T1 is within the range from the first specified value Th1 to the second specified value Th2 and the detection of the inertial rotation number T2 is performed again in the present embodiment, the specified condition is not limited thereto.

Furthermore, although it is determined in three phases in which whether the load is of a large amount, a medium amount or a small amount is determined in the present embodiment, it is not limited thereto, and the load can be determined in more than three phases.

Furthermore, although the load is used for determining the water amount, the load can also be used for determining the washing time and the like other than the water amount.

Further, the structure of the present disclosure can also be used for a double-drum washing machine.

Various changes can be made to other structures without departing from the scope of the technical idea of the present disclosure.

What is claimed is:

1. A washing machine, comprising:

a washing drum, which is capable of accommodating washings and provided with an impeller in a free rotation manner;

a driving part, which rotates the impeller;

an inertial rotation number detection part, which detects a first number of turns of inertial rotation of the impeller after the driving part stops driving, wherein the first number of turns is a first inertial rotation number; and a control part, which controls the driving part and the inertial rotation number detection part, and detects an amount of washings in the washing drum according to the first inertial rotation number, wherein the amount of washings is a load of the washing machine;

wherein the control part detects the load according to the first inertial rotation number through the following manner: in the case that the control part determines that the first inertial rotation number detected by the inertial rotation number detection part is in a range from a first predetermined value to a second predetermined value, the control part enables the driving part to drive again; the inertial rotation number detection part detects a second inertial rotation number of the impeller after the driving part stops driving again; and the control part detects the load according to the first inertial rotation number and the second inertial rotation number, wherein the first predetermined value is less than the second predetermined value;

wherein the control part detects the load according to the first inertial rotation number and the second inertial rotation number through the following manner: the control part compares an absolute value of a difference between the first inertial rotation number and the second inertial rotation number with a third predetermined value, and determines that the load is small in the case that the absolute value of the difference is greater than the third predetermined value and the load is medium in the case that the absolute value of the difference is small than or equal to the third predetermined value.

2. The washing machine according to claim 1, wherein the control part further detects the load according to the first inertial rotation number through the following manner: in the case that the control part determines that the first inertial rotation number detected by the inertial rotation number detection part is less than the first predetermined value, the control part determines that the load is large, and in the case that the first inertial rotation number is greater than the second predetermined value, the control part determines that the load is small.

3. The washing machine according to claim 1, wherein the washing machine comprises a water supply part configured to supply water into the washing drum; and the control part determines an amount of the water supplied by the water supply part into the washing drum according to the detected load.

4. The washing machine according to claim 2, wherein the washing machine comprises a water supply part configured to supply water into the washing drum; and the control part determines an amount of the water supplied by the water supply part into the washing drum according to the detected load.

* * * * *